US007922525B2

(12) United States Patent
Lee

(10) Patent No.: US 7,922,525 B2
(45) Date of Patent: Apr. 12, 2011

(54) USB ELECTRICAL CONNECTOR

(75) Inventor: Gang Lee, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 12/841,818

(22) Filed: Jul. 22, 2010

(65) Prior Publication Data

US 2011/0021068 A1 Jan. 27, 2011

(30) Foreign Application Priority Data

Jul. 24, 2009 (CN) ..... 2009 1 0055474

(51) Int. Cl.
*H01R 13/66* (2006.01)

(52) U.S. Cl. ..... 439/541.5; 439/607.23

(58) Field of Classification Search ..... 439/540.1, 439/541.5, 607.23, 607.5
See application file for complete search history.

(56) References Cited

U.S. PATENT DOCUMENTS 6,099,351 A * 8/2000 Wu ..... 439/607.43
6,155,872 A * 12/2000 Wu ..... 439/541.5
6,238,241 B1 * 5/2001 Zhu et al. ..... 439/541.5
6,238,244 B1 * 5/2001 Yang ..... 439/607.01
6,609,929 B2 * 8/2003 Kamarauskas et al. .... 439/541.5
7,008,762 B2 * 3/2006 Zhang et al. ..... 439/541.5
7,311,556 B2 * 12/2007 Wan et al. ..... 439/607.32
7,625,243 B2 * 12/2009 Chen et al. ..... 439/660
7,670,191 B2 * 3/2010 Ortega et al. ..... 439/660
2002/0048992 A1 * 4/2002 Wang et al. ..... 439/607
2005/0255745 A1 * 11/2005 Walker et al. ..... 439/541.5
2007/0042643 A1 * 2/2007 Zhang et al. ..... 439/607
2009/0311909 A1 * 12/2009 Yu et al. ..... 439/607.23

* cited by examiner

*Primary Examiner* — Briggitte R Hammond
(74) *Attorney, Agent, or Firm* — Baker & Daniels LLP

(57) ABSTRACT

The present invention provides a USB electrical connector having: a plurality of electrical connection units each including a terminal block and at least two rows of conductive terminals embedded in the terminal block. The conductive terminals are embedded in the terminal block by an over-molding process, and wherein each conductive terminal has one end adapted to be electrically connected with a USB plug and the other end adapted to be connected with a printed circuit board. A joint mechanism joins and holds the plurality of electrical connection units, and a fixture fixes the other end of each conductive terminal connected with the printed circuit board. An outer shielding housing encloses the electrical connection units, the joint mechanism and the fixture. The USB electrical connector of the present invention enables a plurality of rows of conductive terminals to be set in stable and good relative positions.

17 Claims, 4 Drawing Sheets

USB ELECTRICAL CONNECTOR

BACKGROUND OF THE INVENTION

1. Field of Invention

The present invention relates to the field of an electrical connector, more particularly, to a USB (Universe Serial Bus) connector.

2. Description of the Related Art

In the prior arts, a computer is usually physically connected with computer peripherals by means of various electrical connectors, for example, a USB electric connector. In order to ensure connection between the USB electrical connector and a USB plug, the locating of conductive terminals of the USB electric connectors and relative positions among the conductive terminals are strictly specified during the design of the USB electric connector. Especially according to the USB 3.0 standard, in a USB electrical connector in which a plurality of stacked rows of conductive terminals are usually provided, the locating of the plurality of rows of conductive terminals and the relative positions among the plurality of rows of conductive terminals have to meet corresponding requirements.

According to design idea and manufacturing manner of the conventional USB electrical connector, the plurality rows of conductive terminals are ordinarily located by being enclosed in a mold in an injection molding process. However, with the current design and manufacturing manner, it is difficult to guarantee the locating of the plurality of rows of conductive terminals and proper relative positions among the conductive terminals.

SUMMARY OF INVENTION

The present invention has been made to overcome or alleviate at least one aspect of the above mentioned disadvantages.

Accordingly, an object of the present invention is to provide a USB electrical connector in which stable and good relative positions among several rows of conductive terminals are obtained.

Another object of the present invention is to provide a USB electrical connector that comprises separate electrical connection units that can be joined with one another directly.

A further object of the present invention is to provide a USB electrical connector that comprises a plurality of stackable electrical connection units.

According to one aspect of the present invention, a USB electrical connector is provided, the USB electrical connector comprises: a plurality of electrical connection units each including a terminal block and at least two rows of conductive terminals embedded in the terminal block, wherein the conductive terminals are embedded in the terminal block by an overmolding process, and wherein each conductive terminal has one end adapted to be electrically connected with a USB plug and the other end adapted to be connected with a printed circuit board; a joint mechanism for joining and holding the plurality of electrical connection units; a fixture for fixing the other end of each conductive terminal connected with the printed circuit board; and an outer shielding housing constructed to enclose the electrical connection units, the joint mechanism and the fixture from outside.

In an exemplary embodiment, the electrical connection units are stacked in a lower-upper direction and embedded in the joint mechanism. In another exemplary embodiment, however, the plurality of electrical connection units, can also be stacked in a right-left direction and embedded in the joint mechanism. It should be noted that the joint mechanism is an individual member separable from the electrical connection units in the above exemplary embodiments.

Alternatively, in each individual electrical connection unit, the one end of the conductive terminal that is embedded in the terminal block and electrically connected with the USB plug, is perpendicular to the other end of the conductive terminal connected with the printed circuit board.

Specifically, the plurality of electrical connection units comprises two electrical connection units, and the length of each conductive terminal of the upper electrical connection unit is longer than that of each conductive terminal of the lower electrical connection unit at the side close to the printed circuit board.

Alternatively, the at least two rows of conductive terminals are parallel with each other.

Alternatively, the joint mechanism comprises locating grooves corresponding to the electrical connection units in number, wherein the plurality of electrical connection units are embedded in the joint mechanism through corresponding locating grooves respectively.

Alternatively, the fixture is provided with several rows of through holes through which pass the ends of the conductive terminals adapted to be connected with the printed circuit board.

Alternatively, the USB electrical connector further comprises an inner shielding housing constructed to enclose the joint mechanism from outside so as to form an electrical shield among the electrical connection units. More specifically, the joint mechanism includes an extension portion, and the inner shielding housing has a pair of extending sheets, wherein the extension portion is adapted to be inserted between the pair of extending sheets. Alternatively, the extension portion is provided with recesses, and the pair of extending sheets is provided with protrusions matching the recesses.

According to a further exemplary embodiment of the present invention, the joint mechanism may be a non-individual member. Specifically, the joint mechanism comprises a first joining part formed on one electrical connection unit, and a second joining part formed on another electrical connection unit opposite to the one electrical connection unit, wherein the first and second joining parts are fitted with each other so that the plurality of electrical connection units are connected integrally. Alternatively, the plurality of electrical connection units, while stacked in a lower-upper direction, are connected integrally through the first and second joining parts; or the plurality of electrical connection units, while arranged in a right-left direction, are connected integrally through the first and second joining parts.

Specifically, the electrical connection units comprise two or more electrical connection units, wherein one joint mechanism is provided between two adjacent electrical connection units.

Specifically, the first joining part is a groove portion, and the second joining part is a protruding portion snapping to the groove portion.

Alternatively, the USB electrical connector further comprises a locating part for maintaining the joining between the plurality of electrical connection units, wherein the locating part includes a locating hole formed on one electrical connection unit and a locating column formed on another electrical connection unit opposite to the one electrical connection unit, wherein the locating hole and the locating column are fitted together to maintain accurate locating between the electrical connection units.

With the above configuration, the present invention provides at least one of following advantages: with respect to the double-layer USB 2.0 electrical connector which is manufactured in a conventional process in the art, the USB electrical connector according to the present invention can be produced by first enclosing a single row of conductive terminals in the terminal block by a overmolding process so as to form a separate electrical connection unit, then by integrating two or more separate electrical connection units by means of the joint mechanism so that stable and good relative positions between two or more rows of conductive terminals are obtained; in addition, the plurality of electrical connection units are stacked directly by means of the joint mechanism in the present invention, in this case, a certain number of electrical connection units can be stacked, if necessary, based on different design requirements. It should be noted that the joint mechanism of the USB electrical connector of the present invention may be a separate member, or be certain structures which are integrally attached to respective electrical connection units so as to join the respective electrical connection units.

BRIEF DESCRIPTION OF THE DRAWING

These and/or other aspects and advantages of the invention will become apparent and more readily appreciated from the following description of the embodiments, taken in conjunction with the accompanying drawings of which.

DETAILED DESCRIPTION OF PREFERRED EMBODIMENTS

Figure 1:
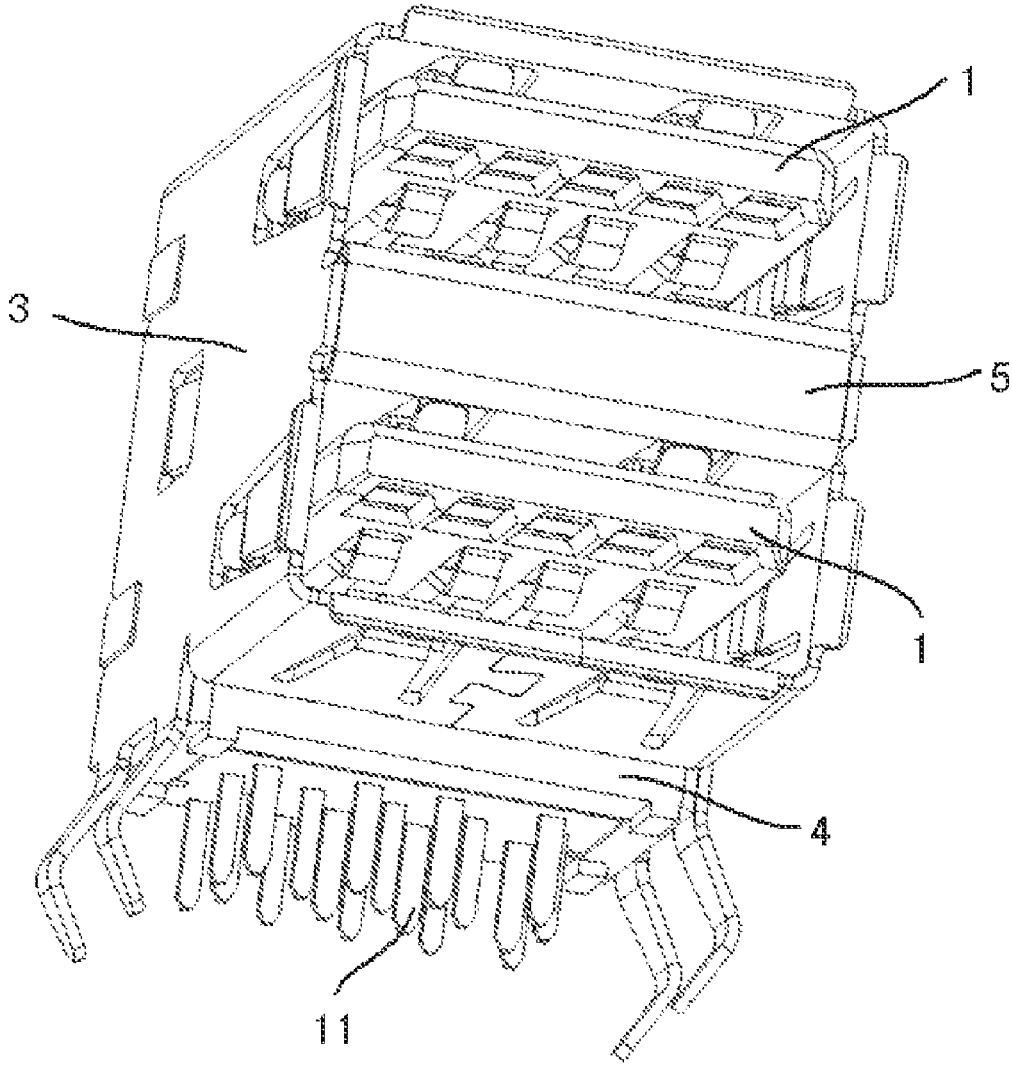
FIG. 1 illustrates schematically an overall structure of a USB electrical connector according to a first exemplary embodiment of the present invention.

Exemplary embodiments of the present disclosure will be described hereinafter in detail with reference to the attached drawings, wherein the like reference numerals refer to the like elements.

The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art. The scope of the present invention will in no way be limited to the simply schematic views of the drawings, the number, materials, shapes, relative arrangement, etc., of constituting components are disclosed simply as an example of an embodiment.

Figure 2:
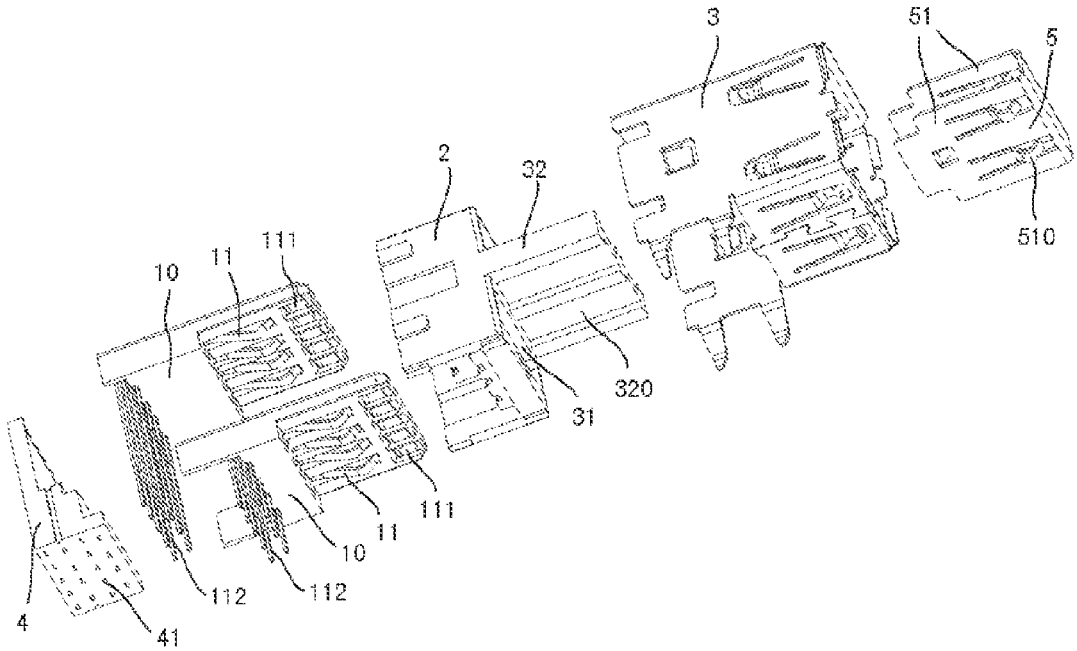
FIG. 2 is a schematic exploded view illustrating the structure of the USB electrical connector according to the first exemplary embodiment of the present invention.

FIGS. 1-2 shows a USB electrical connector of the present invention, wherein FIG. 1 illustrates schematically an overall structure of the USB electrical connector according to the first exemplary embodiment of the present invention; FIG. 2 is a schematic exploded view illustrating the structure of the USB electrical connector according to the first exemplary embodiment of the present invention.

As shown in FIGS. 1-2, the USB electrical connector according to the first exemplary embodiment of the present invention mainly comprises a plurality of electrical connection units 1, a joint mechanism 2, an outer shielding housing 3, and a fixture 4, and an inner shielding housing 5, wherein each of the plurality of electrical connection units 1 may be connected electrically with a USB plug (not shown) and a printed circuit board (PCB, not shown) and includes a terminal block 10 and at least two rows of conductive terminals 11 embedded in the terminal block 10. The conductive terminals 11 are embedded in the terminal block 10 by an overmolding process, and one end 111 of each conductive terminal 11 is adapted to be connected electrically with the USB plug while the other end thereof is adapted to be connected with the printed circuit board. The joint mechanism 2 is constructed to join and hold the plurality of electrical connection units, the fixture 4 is constructed to fix the other end 112 of each conductive terminal 11 connected with the printed circuit board. The outer shield housing 3 encloses the electrical connection units 1, the joint mechanism 2 and the fixture 4 from outside. In the USB electrical connector of the above exemplary embodiment, each of the plurality of electrical connection units 1 is fixed in the joint mechanism 2.

As shown in FIGS. 1 and 2, according to the first exemplary embodiment of the present invention, the plurality of electrical connection units 1 stacked in a lower-upper direction are embedded in the joint mechanism 2. The arrangement of the electrical connection units 1 in the joint mechanism 2 may be modified based on specific requirements. For example, in another exemplary embodiment of the present invention, the plurality of electrical connection units 1 stacked in a right-left direction are embedded in the joint mechanism 2.

In addition, each electrical connection unit 1 may be connected electrically with the USB plug and the printed circuit board. According to the first exemplary embodiment of the present invention, as for each electrical connection unit 1, the one end 111 of the conductive terminal 11 that is embedded in the terminal block 10 and electrically connected with the USB plug, is perpendicular to the other end 112 of the each conductive terminal 11 connected with the printed circuit board. As shown in FIG. 2, the terminal block 10 of the electrical connection unit 1 is substantially of a flat rectangular shape, and the one end 111 electrically connected with the USB plug is embedded in a front end of the terminal block 10, and the other end 112 of the conductive terminal 11 extends, from a rear end of the flat terminal block 10, downward in a direction substantially perpendicular to the flat terminal block 10 for connecting electrically with the printed circuit board. Specifically, the conductive terminals 11 are enclosed in the terminal block 10 by a molding process, for example, an overmolding process. In the present invention, however, the specific structures of the terminal block 10 and the conductive terminals 11 in the electrical connection unit 1 are not limited to this.

According to the first exemplary embodiment of the present invention, the USB electrical connector specifically comprises two electrical connection units 1 (FIG. 1). As shown in FIG. 2, at the ends 112 connected with the printed circuit board, i.e., at the back side of the terminal block 10, the length of each conductive terminal 11 of the upper electrical connection unit is longer than that of each conductive terminal 11 of the lower electrical connection unit, meanwhile, the at least two rows of conductive terminals in each electrical connection unit 1 are parallel with one another. Further, as shown in FIG. 1, in the USB electrical connector of the present invention, the rows of conductive terminals 11 in one electrical connection unit 1 are parallel with those of conductive terminals 11 in another electrical connection unit 1; moreover, the conductive terminals 11 of different rows of one electrical connection unit 1 are staggered.

In the first exemplary embodiment, as shown in FIG. 2, the joint mechanism 2 is one separate member. The joint mechanism 2 comprises locating grooves 31 corresponding to the electrical connection units 1 in number, wherein the plurality of electrical connection units 1 are embedded in the joint mechanism 2 through corresponding locating grooves 31 respectively. Specifically, in the present embodiment, two locating grooves 31 are formed in the joint mechanism 2, and two electrical connection units 1 respectively pass through the corresponding locating grooves 31 and thus are fixed to the joint mechanism 2 by the locating grooves 31 so that a complete electrical connection member is formed.

Moreover, the USB electrical connector of the present invention further comprises an inner shielding housing 5 which encloses the joint mechanism 2 from the outside so as to form an electrical shield between the electrical connection units 1. Specifically, the joint mechanism 2 includes an extension portion 32, and the inner shielding housing 5 has a pair of extending plates 51, wherein the extension portion 32 is adapted to be inserted between the pair of extending plates 51, in this case, the inner shielding housing 5 is connected with the joint mechanism 2 with the electrical connection units 1 integrated therein so as to form an integrated member. As shown in FIG. 2, the extension portion 32 may be provided with recesses 320, and the pair of extending plates 51 may be provided with protrusions 510 for fitting with the recesses 320.

In the USB electric connector, the fixture 4 is used to fix the electrical connection units 1. Specifically, the fixture 4 is provided with several rows of through holes 41 through which the ends 112 of the conductive terminals 11 adapted to be connected with the printed circuit board pass. Thus, by inserting the ends 112 of the conductive terminals 11, which are adapted to be connected with the printed circuit board, into the through holes 41 of the fixture 4, and then fixing the electrical connection units 1 in the outer shield housing 3, a complete USB electrical connector is obtained.

As a result, in the USB electrical connector of the present invention, a connection receptacle (that is, the outer shield housing 3) is used to join, in a manner of stacking, two or more individual function cells (that is, the electrical connection units 1 for connecting electrically with the USB plug and the printed circuit board) so as to form a whole connector, wherein each individual function cell (the electrical connection unit 1) is formed by enclosing the conductive terminals 11 in a mold (that is, the terminal block 10) by way of an overmolding process, for example, an injection molding process.

The USB electrical connector according to the first exemplary embodiment of the present invention may be manufactured at least by the following steps: molding a single row of conductive terminals 11 in the terminal block 10 to locate the single row of conductive terminals and form one individual electrical connection unit 1; then assembling each of the individual electrical connection units 1 to one joint mechanism 2 to integrate the assembled electrical connection units 1 so that good relative positions among the conductive terminals 11 of the individual electrical connection units 1 are ensured; and then assembling other component of the USB electric connector, and the joint mechanism 2 with the electrical connection units 1 mounted therein for meeting the functional requirements on the USB electric connector.

With respect to the double-layer USB 2.0 electrical connector which is manufactured in a conventional process in the art, the USB electrical connector according to the present invention can be produced by first enclosing a single row of conductive terminals in the terminal block by an overmolding process so as to form a separate electrical connection unit, then by integrating two or more separate electrical connection units by means of the joint mechanism so that stable and good relative positions between two or more rows of conductive terminals are obtained.

Figure 3:
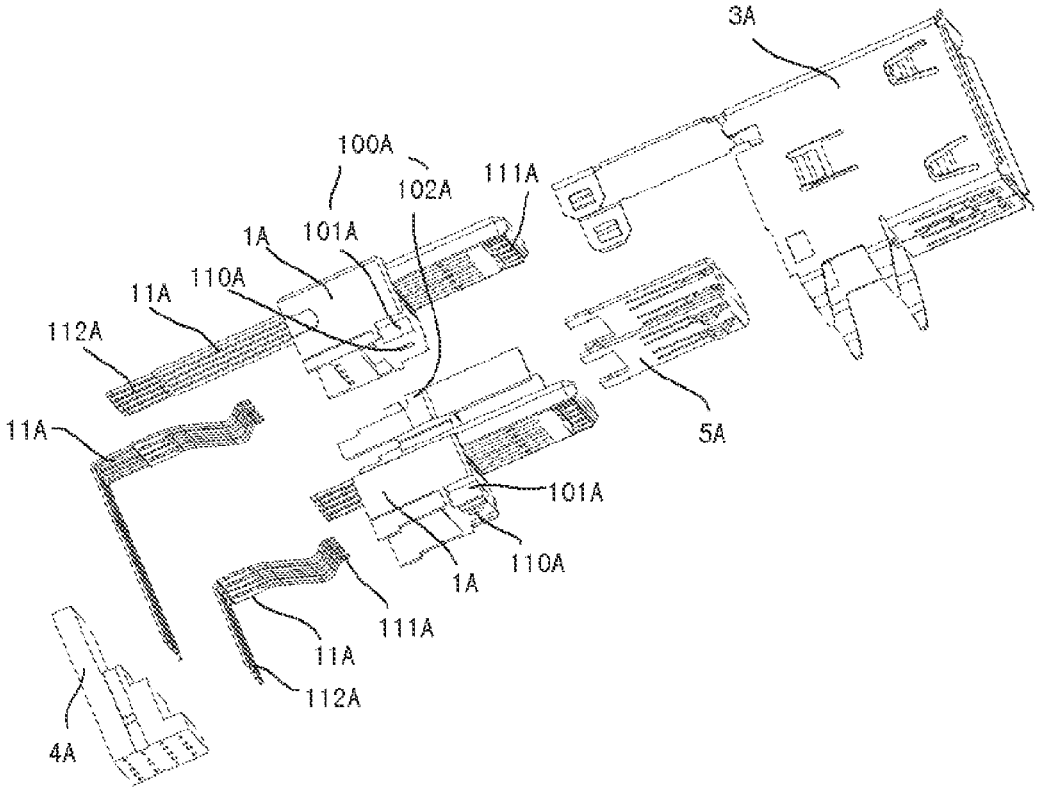
FIG. 3 is a schematic exploded view illustrating the structure of a USB electrical connector according to a second exemplary embodiment of the present invention.

A second exemplary embodiment of the present invention will be described with reference to FIGS. 3 and 4. FIG. 3 is a schematic exploded view illustrating the structure of a USB electrical connector according to the second exemplary embodiment of the present invention; and FIG. 4 is a schematic exploded view illustrating the joining structure between two electrical connection units of the USB electrical connector according to the second exemplary embodiment of the present invention.

Figure 4:
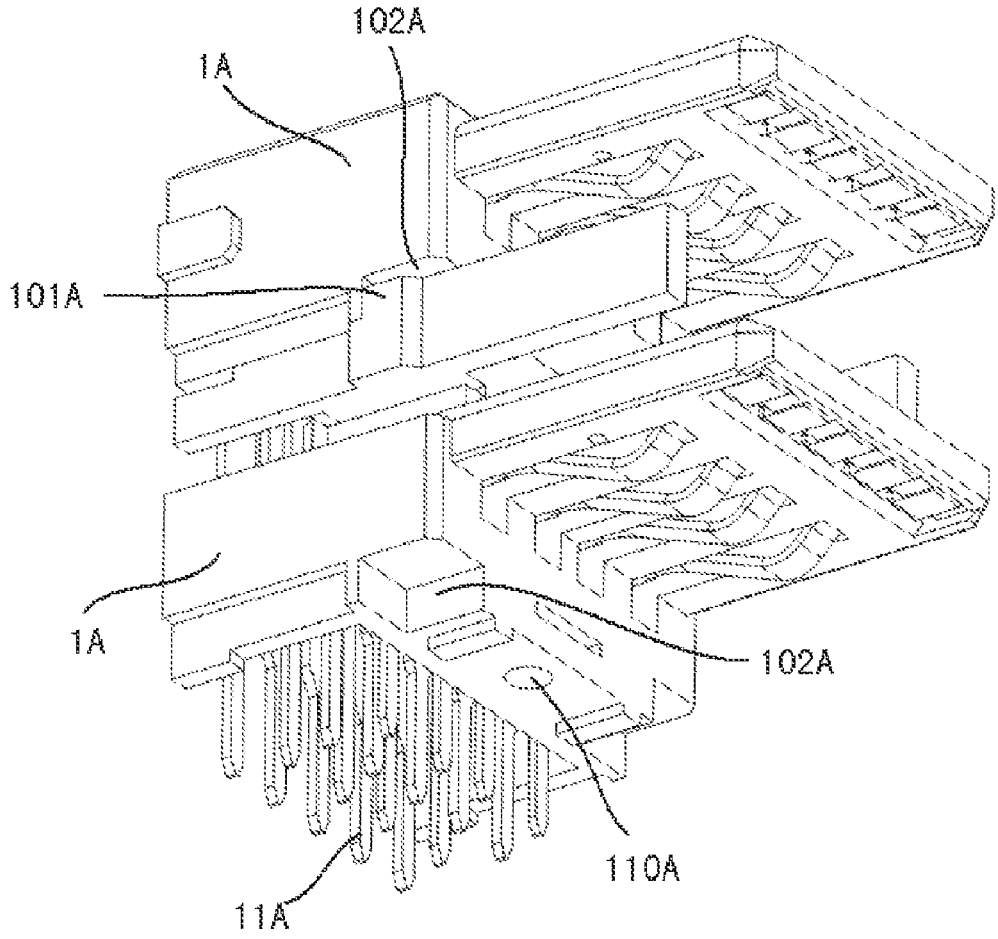
FIG. 4 is a schematic exploded view illustrating the joining structure between two electrical connection units of the USB electrical connector according to the second exemplary embodiment of the present invention.

As shown in FIGS. 3-4, the joining manner and joining structure between the electrical connection units 1 in the second exemplary embodiment differs from that in the first exemplary embodiment, while structures of other parts in the second exemplary embodiment are the same as or similar to those in the first exemplary embodiment. For the purpose of simplicity, only the joining manner and joining structure in the second exemplary embodiment will be described in detail.

Specifically, as shown in FIGS. 3-4, the USB electrical connector according to the second exemplary embodiment of the present invention mainly comprises a plurality of electrical connection units 1A, a joint mechanism 100A, an outer shielding housing 3A, and a fixture 4A, wherein each of the plurality of electrical connection units 1A may be connected electrically with a USB plug (not shown) and a printed circuit board (not shown), and includes a terminal block 10A and at least two rows of conductive terminals 11A embedded in the terminal block 10A. The conductive terminals 11A are embedded in the terminal block 10A by an overmolding process, for example, an injection molding process, and one end 111A of each conductive terminal is adapted to be connected electrically with the USB plug while the other end thereof is adapted to be connected with the printed circuit board. The joint mechanism 100A is constructed to join and hold the plurality of electrical connection units 1A, and the fixture 4A is constructed to fix the other end 112A of each conductive terminal 11A connected with the printed circuit board. The outer shield housing 3A encloses the electrical connection units 1A, the joint mechanism 100A and the fixture 4A from outside. In the USB electrical connector of the second exemplary embodiment, the plurality of electrical connection units 1A are integrated by the joint mechanism 100A. In addition, as shown in FIG. 4, the USB electrical connector may further comprise an inner shielding housing 5A.

As shown in FIGS. 3-4, the joint mechanism 100A according to the second exemplary embodiment of the present invention comprises a first joining part 101A formed on one electrical connection unit 1A, and a second joining part 102A which is formed on another electrical connection unit 1A opposite to the one electrical connection unit 1A, wherein the first and second joining parts are fitted with each other so that the plurality of electrical connection units 1A are connected integrally. Thus, in the second exemplary embodiment, the plurality of electrical connection units 1A are integrated or joined together by the joint mechanism 100A provided on the electrical connection units so that a separate or individual joint mechanism is not necessary, which differs much from the solution in the first exemplary embodiment in which the plurality of electrical connection units 1 are integrated by means of a separate joint mechanism 2. In other words, in the first exemplary embodiment, the plurality of electrical connection units 1 are connected together by the joint mechanism 2 acting as an individual member, while in the second exemplary embodiment, the plurality of electrical connection units 1A are connected together by means of the joint mechanism 100A which comprises specific structures integrally attached to respective electrical connection units 1A. With such a configuration disclosed in the second exemplary embodiment, a separate member can be omitted and also the assembly of the USB electrical connector is facilitated.

Referring to FIGS. 3 and 4, according to the second exemplary embodiment of the present invention, the plurality of electrical connection units 1A, while stacked in a lower-upper direction as shown in FIG. 4, are connected integrally through the first and second joining parts. The arrangement of the electrical connection units 1A may be modified based on specific requirements, for example, in another exemplary embodiment of the present invention, the plurality of electrical connection units 1A, while arranged in a right-left direction, are connected integrally through the first and second joining parts.

Specifically, in the second exemplary embodiment, the first joining part 101A may be a groove portion 101A, and the second joining part 102A may be a protruding portion 102A snap-fitting with the groove portion. As shown in FIG. 3, through a snap fit between the groove portions 101A, formed on both sides of the body of the upper electrical connection unit 1A, and the protruding portions 102A, formed on both sides of the body of the lower electrical connection unit 1A, the upper and lower electrical connection units 1A can be joined together. Obviously, the joining manner and joining structure between the electrical connection units in the USB electrical connector of the present invention, may be any one that can join together two or more electrical connection units, that is, it should not be limited to the snap fit between the groove portion and the protruding portion.

Further, the USB electrical connector according to the second exemplary embodiment further comprises a locating part for maintaining the joining between the plurality of electrical connection units 1A, wherein the locating part comprises a locating hole 110A formed on one electrical connection unit 1A and a locating column (not shown) which is formed on another electrical connection unit opposite to the one electrical connection unit, wherein the locating hole and the locating column are fitted together to maintain accurate locating between the electrical connection units 1A. It should be noted that the specific structure of the locating part of the electrical connection unit 1A is not limited to this.

According to the second exemplary embodiment, the plurality of electrical connection units 1A comprise two or more electrical connection units 1A, and one joint mechanism 100A is provided between two adjacent electrical connection units 1A. Though there are two electrical connection units 1A in FIGS. 3-4, there may be three or more of the electrical connection units 1A which can be connected directly with each other.

The USB electrical connector according to the second exemplary embodiment of the present invention enables a plurality of rows of conductive terminals to be in stable and good relative positions. In addition, since a plurality of individual electrical connection units are directly connected together in a stacking manner by the joint mechanism, a certain number of electrical connection units can be stacked, if necessary, based on different design requirements.

Although several exemplary embodiments have been shown and described, it would be appreciated by those skilled in the art that various changes or modifications may be made in these embodiments without departing from the principles and spirit of the disclosure, the scope of which is defined in the appended claims and their equivalents.

The invention claimed is:

1. A USB electrical connector comprising:

a plurality of electrical connection units each including a terminal block and at least two rows of conductive terminals embedded in the terminal block, wherein the conductive terminals are embedded in the terminal block by an overmolding process, and wherein each conductive terminal has one end adapted to be electrically connected with a USB plug and the other end adapted to be connected with a printed circuit board;

a joint mechanism for joining and holding the plurality of electrical connection units;

a fixture for fixing the other end of each conductive terminal that is connected with the printed circuit board; and an outer shielding housing being constructed to enclose the electrical connection units, the joint mechanism and the fixture.

2. The USB electrical connector according to claim 1, wherein the plurality of electrical connection units are stacked in a lower-upper direction and embedded in the joint mechanism.

3. The USB electrical connector according to claim 1, wherein the plurality of electrical connection units are arranged in a right-left direction and embedded in the joint mechanism.

4. The USB electrical connector according to claim 2, wherein in each electrical connection unit, the one end of each conductive terminal that is embedded in the terminal block and electrically connected with the USB plug, is perpendicular to the other end of each conductive terminal connected with the printed circuit board.

5. The USB electrical connector according to claim 2, wherein the plurality of electrical connection units comprise two electrical connection units, and the length of each conductive terminal of the upper electrical connection unit is longer than that of each conductive terminal of the lower electrical connection unit at the side close to the printed circuit board.

6. The USB electrical connector according to claim 1, wherein the at least two rows of conductive terminals are parallel with one another.

7. The USB electrical connector according to claim 1, wherein the joint mechanism comprises locating grooves corresponding to the number of electrical connection units, and the electrical connection units are embedded in the joint mechanism through corresponding locating grooves respectively.

8. The USB electrical connector according to claim 2, wherein the fixture is provided with several rows of through holes through which the ends of the conductive terminals adapted to be connected with the printed circuit board pass.

9. The USB electrical connector according to claim 1, further comprising: an inner shielding housing constructed to enclose the joint mechanism from outside so as to form an electrical shield among the plurality of electrical connection units.

10. The USB electrical connector according to claim 9, wherein the joint mechanism includes an extension portion, and the inner shielding housing has a pair of extending plates, wherein the extension portion is adapted to be inserted between the pair of extending plates.

11. The USB electrical connector according to claim 9, wherein the extension portion is provided with recesses, and the pair of extending plates are provided with protrusions fitting with the recesses.

12. The USB electrical connector according to claim 1, wherein the joint mechanism comprises a first joining part formed on one electrical connection unit, and a second joining part formed on another electrical connection unit opposite to the one electrical connection unit, wherein the first and second joining parts are fitted with each other so that the plurality of electrical connection units are connected integrally.

13. The USB electrical connector according to claim 12, wherein the plurality of electrical connection units stacked in a lower-upper direction, and are connected integrally through the first and second joining parts.

14. The USB electrical connector according to claim 12, wherein the plurality of electrical connection units stacked in a right-left direction, and are connected integrally through the first and second joining parts.

15. The USB electrical connector according to claim 12, wherein the plurality of electrical connection units comprise two or more electrical connection units, wherein one joint mechanism is provided between every two adjacent electrical connection units.

16. The USB electrical connector according to claim 12, wherein the first joining part is a groove portion, and the second joining part is a protruding portion snap to the groove portion.

17. The USB electrical connector according to claim 12, further comprising a locating part for maintaining the joining among the plurality of electrical connection units, wherein the locating part comprises a locating hole formed on one electrical connection unit and a locating column formed on another electrical connection unit opposite to the one electrical connection unit, wherein the locating hole and the locating column are fitted together to maintain accurate locating between the electrical connection units.

* * * * *